United States Patent [19]

Niederer

[11] Patent Number: 4,978,269

[45] Date of Patent: Dec. 18, 1990

[54] VACUUM CONTROLLED LIFTING APPARATUS

[75] Inventor: Kurt W. Niederer, Charlotte, N.C.

[73] Assignee: Toter, Inc., Statesville, N.C.

[21] Appl. No.: 318,135

[22] Filed: Mar. 2, 1989

[51] Int. Cl.[5] ..... B66C 1/02

[52] U.S. Cl. ..... 414/421; 294/64.1; 414/408

[58] Field of Search ..... 414/408, 419, 421; 294/64.1; 248/363, 205.5, 207.5; 114/250

[56] References Cited

U.S. PATENT DOCUMENTS

| | | | |
|---|---|---|---|
| 2,745,665 | 5/1956 | Labombarde | 294/64.1 |
| 3,152,828 | 10/1964 | Lytle | 294/64 |
| 3,227,481 | 1/1966 | Creskoff | 294/64 |
| 3,272,549 | 9/1966 | Nisula | 294/64.1 |
| 3,326,593 | 6/1967 | Farmer et al. | 294/64.1 |
| 3,515,424 | 11/1967 | Sjodin | 294/64.1 |
| 3,613,904 | 10/1971 | Blatt . | |
| 3,923,177 | 12/1975 | Horton . | |
| 4,057,156 | 11/1977 | Thompson et al. | 414/408 |
| 4,600,229 | 7/1986 | Oten | 294/64.1 |

FOREIGN PATENT DOCUMENTS

| | | | |
|---|---|---|---|
| 0960248 | 12/1974 | Canada | 294/64.1 |
| 0117388 | 8/1969 | Norway | 294/64.1 |
| 1598795 | 9/1981 | United Kingdom | 294/64.1 |

*Primary Examiner*—Joseph F. Peters, Jr.
*Assistant Examiner*—Edwin L. Swinehart
*Attorney, Agent, or Firm*—W. Thad Adams, III

[57] ABSTRACT

A vacuum-controlled apparatus for gripping or gripping and lifting a load such as a roll-out refuse container. The lifting apparatus includes a primary vacuum pad for initially engaging the load, the primary vacuum pad comprising a vacuum head for exerting a vacuum-induced suction grip on the load, secondary vacuum pad carried by the vacuum head for secondarily engaging the load and supplementing the vacuum-induced grip on the load. A lifting arm effects vertical movement of the load. The vacuum pads are resilient and have a load-contacting surface on one side thereof generally corresponding to the shape of a surface of the load to be contacted by the load-contacting surface.

15 Claims, 10 Drawing Sheets

PRIOR ART

FIG. 3
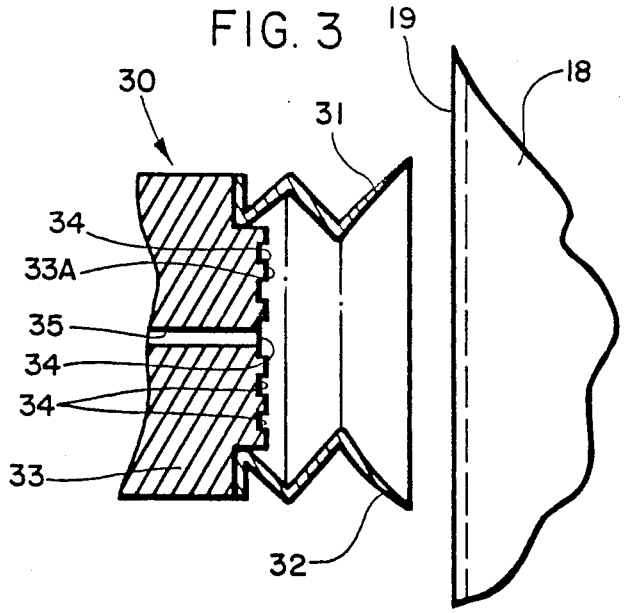
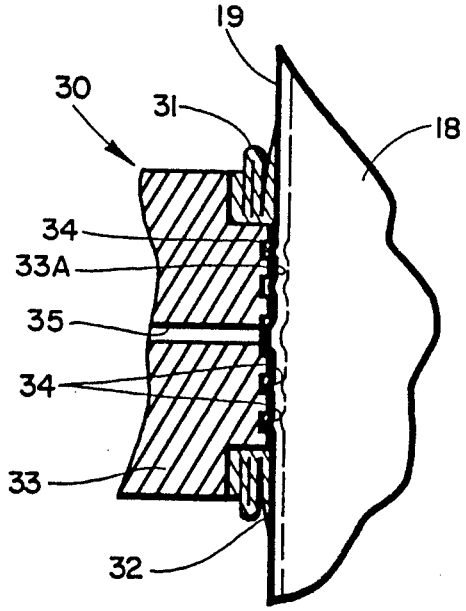
FIG. 4

VACUUM CONTROLLED LIFTING APPARATUS

TECHNICAL FIELD AND BACKGROUND OF THE INVENTION

This invention relates to a vacuum-controlled vertical lifting apparatus for lifting a load. The particular embodiment disclosed in this application is an apparatus for lifting and dumping a refuse container. The lifting apparatus is typically attached to the back of a refuse collection truck. The refuse container preferably used with the lifting apparatus is a lightweight plastic container mounted on wheels and generally referred to as a "rollout" refuse container. While relatively lightweight, these containers are large and the materials from which they are constructed are inherently low in friction. Also, the containers are quite often wet from rain or snow when emptied. These factors increase the problem of shearing, in which an object being held by a vertical side tends to slip downwardly under the influence of gravity.

Prior art lifting units generally have hooks which engage bars or molded recesses in the container. The hooks are attached to an arm which lifts and inverts the container over the vehicle where the contents of the container free fall out of the container. These prior art lifting units can cause damage to the container particularly if the container is not loaded properly onto the hooks or if the vehicle is parked on a hill or uneven pavement. As the container is being lowered after emptying the bottom of the container can hit the pavement before the hooks disengage the container, damaging the lifting elements of the container.

These prior art devices are referred to as "semi-automatic" units since the container must be carefully oriented manually onto the hooks before lifting can begin. Since containers made for use on these units have lifting elements only on one side, the container must be manually rotated up to 180° before moving the container into engagement with the hooks. This slows down the collection process. These disadvantages have effectively prevented the development of a completely automated lifting system wherein the container is moved into the proximity of the lifting unit without orientation of the container being required, whereupon the container is lifted.

The use of vacuum presents several desirable possibilities. In particular, since vacuum operates most effectively on a smooth, flat or regularly curved surface, a container having a simple, clean design is possible. Likewise, a vacuum pad can attach itself to many different areas of a container and can thus make precise orientation of the container unnecessary. Other problems such as unlevel or sidehill surfaces are minimized. Should the container collide with another object, the container can be knocked loose before damage is done to the container or the lifting unit. The application of both a vacuum and mechanical hold on the container reduces or eliminates the tendency of shear forces to cause the container to slide of fall from the vacuum pad.

SUMMARY OF THE INVENTION

Therefore, it is an object of the invention to provide a vacuum-controlled vertical lifting apparatus particularly adapted for lifting and emptying roll-out refuse containers.

It is another object of the invention to provide a vacuum-controlled vertical lifting apparatus suitable for use on loads having an engagement surface of a low friction material or which are wet.

It is another object of the invention to provide a vacuum-controlled vertical lifting apparatus which will lift refuse containers with no or a minimum of manual orientation of the container to the lifting apparatus.

It is another object of the invention to provide a vacuum-controlled vertical lifting apparatus which provides both vacuum and mechanical lifting engagement with the container.

It is another object of the invention to provide a vacuum-controlled vertical lifting apparatus which is adapted to be mounted on the side or on the rear of a refuse collection truck.

These and other objects of the present invention are achieved in the preferred embodiments disclosed below by providing a vacuum-controlled vertical lifting apparatus for lifting a load, and comprising primary vacuum means for initially engaging the load, the primary vacuum means comprising a vacuum head for exerting a vacuum-induced suction grip on the load, and secondary vacuum means carried by the vacuum head for secondarily engaging the load and supplementing the vacuum-induced grip on the load. Lifting means effect vertical movement of the load.

According to one preferred embodiment of the invention, the vacuum head comprises a resilient vacuum pad defining a load-contacting surface on one side thereof generally corresponding to the shape of a surface of the load to be contacted by the load-contacting surface.

According to another preferred embodiment of the invention, the vacuum head comprises a first resilient vacuum pad defining a first load-contacting surface, and wherein the secondary vacuum means comprises a second resilient vacuum pad positioned within the periphery of the first resilient vacuum pad and defining a second load-contacting surface.

According to yet another preferred embodiment of the invention, the load-contacting surface of the first resilient vacuum pad comprises a first outwardly-extending load-engaging flange for first engaging the load as the lifting apparatus and load are moved together, and the load-contacting surface of the secondary vacuum means includes a second outwardly-extending load-engaging flange of a length for engaging the load after engagement between the load and the first vacuum pad.

Preferably, the load-contacting surface of the first resilient vacuum pad comprises a first outwardly-extending load-engaging flange for first engaging the load as the lifting apparatus and load are moved together, and the load-contacting surface of the secondary vacuum means includes a second outwardly-extending load-engaging flange of a length for engaging the load before engagement between the load and the first vacuum pad.

According to one preferred embodiment of the invention, the first and second load-engaging flanges are both circular and each define a circle of increasing diameter towards a free end thereof.

According to another preferred embodiment of the invention, the first and second load-engaging flanges have walls of decreasing thickness towards the free end.

According to another preferred embodiment of the invention, the first load-engaging flange includes bellows-like pleats to permit the flange collapse on itself as vacuum is exerted on the load.

According to yet another preferred embodiment of the invention, the first load-contacting surface comprises a load-engaging flange, and wherein the second load-contacting surface comprises spaced-apart mechanical engagement means for bearing against and deforming the load into spaces therebetween to provide a mechanical lifting assist against vertical shearing movement of the load against the first load-contacting surface.

Preferably, the first load-engaging flange is formed into bellows-like pleats to collapse on itself as vacuum is exerted on the load.

According to one preferred embodiment of the invention, the mechanical engagement means comprises laterally and outwardly extending lugs.

According to another preferred embodiment of the invention, the apparatus includes mechanical engagement means cooperating with the first and second load-contacting surfaces, and comprising laterally and outwardly extending lugs.

Preferably, the invention includes sensor means for sensing a predetermined location of the load relative to the vacuum head and activating the vacuum upon the occurrence of the predetermined location.

Preferably, the load comprises a refuse container.

Preferably, the invention includes means for attaching to and carrying the apparatus on a refuse collection vehicle.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 3 is a vertical cross-sectional view of a vacuum pad according to one embodiment of the invention;

FIG. 4 is a vertical cross-sectional view of the vacuum pad shown in FIG. 3 in holding position;

DESCRIPTION OF THE PREFERRED EMBODIMENT AND BEST MODE

Figure 1:
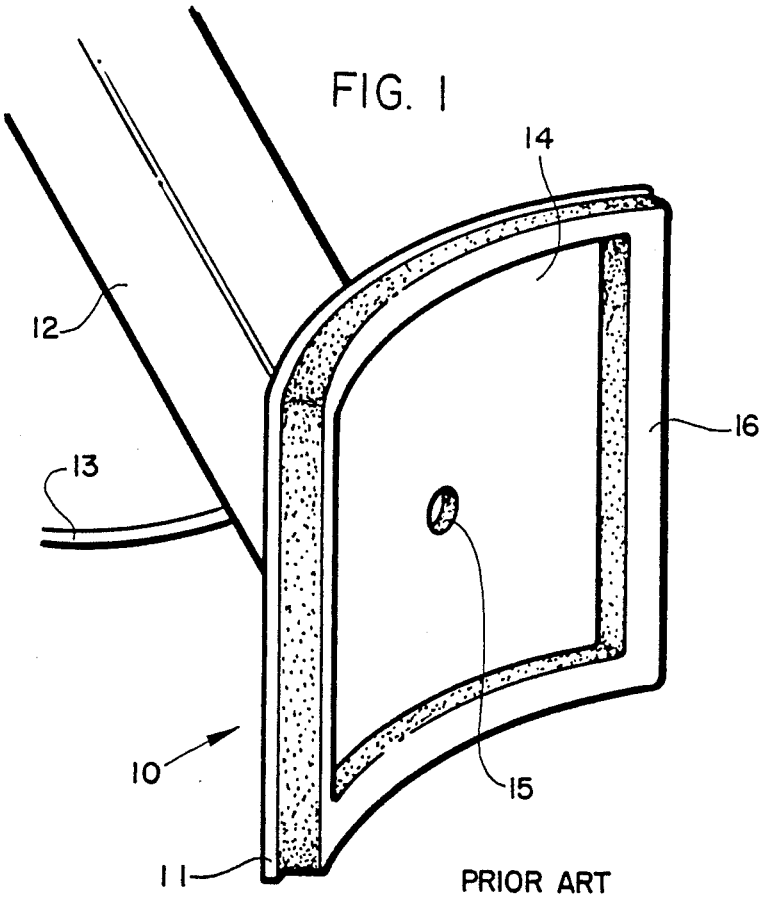
FIG. 1 is a perspective view of a prior art vacuum pad.

Referring now specifically to the drawings, a vacuum lifting apparatus according to the prior art is illustrated in FIG. 1 and shown generally at reference numeral 10. Apparatus 10 includes a curved plate 11 for fitting a predetermined mating curve on the load to be lifted. Plate 11 is mounted on the end of a boom 12 and is supplied with negative air pressure through a vacuum line 13 from a vacuum pump, not shown. Line 13 communicates with the holding face 14 of plate 11 through an aperture 15. A seal is effected with the load by means of a resilient seal 16 which is secured to face 14 around its periphery. As is apparent, if the single seal is broken, vacuum holding pressure cannot be maintained and the load must fall. Vacuum pressure alone acts as a holding means.

Figure 2:
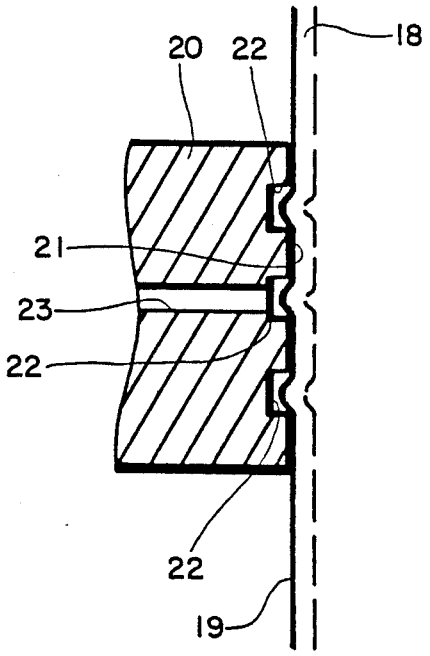
FIG. 2 is a vertical cross-sectional view of a vacuum pad to illustrate mechanical resistance against shear.

Referring now to FIG. 2, the underlying principle by which the various embodiments of the invention disclosed herein operate is explained. In FIG. 2, a load 18 having a deformable side wall 19 is being lifted. Such a load could be a lightweight plastic roll-out refuse container formed by a number of processes including rotational or blow molding. A lifting apparatus 20 has a holding face 21 interrupted by spaced-apart channels 22 defining outwardly extending lugs 22*a*. Lifting apparatus 20 is preferably fabricated of a durable rubber or resilient plastic material. Channels 22 are interconnected by cross-channels (not shown) to permit vacuum pressure to communicate with all of the channels 22 through a single vacuum line 23. Sufficient suction is supplied to not only exert a direct holding vacuum pressure on the load 18 but to also deform the load wall 19 outwardly over lugs 22*a* and into the channels 22.

These outwardly-extending deformations interrupt the smooth holding surface and provide a mechanical interlock between the lifting apparatus 20 and the load 18. Downward movement of the load 18 caused by shear forces between the lifting apparatus 20 and the load 18 are reduced to the point where slippage is prevented. This is a particularly significant factor when the surface 19 of load 18 is wet. The lifting apparatus 20 may be any shape required to mate with the surface of the load.

FIG. 3 and 4 illustrate a lifting apparatus 30 which includes a primary vacuum pad 31. Primary vacuum pad 31 comprises an annular pleated flange 32 of decreasing wall thickness towards its free end. The pleated flange 32 is constructed in a bellows-like fashion which will collapse on itself as vacuum is exerted on the load 18.

Lifting apparatus 30 has a head 33 having a holding face 33*a* interrupted by spaced-apart channels 34. Lifting apparatus 30 is preferably fabricated of a durable rubber or resilient plastic material. Channels 34 are interconnected by cross-channels (not shown) to permit vacuum to all of the channels 34 through a single vacuum line 35. Sufficient suction is supplied to not only exert a direct holding vacuum pressure on the load 18 but to also deform the load wall 19 outwardly into the channels 34. The interaction of channels 34 and holding face 33 define a secondary vacuum pad which cooperates with the primary vacuum pad 31 to provide a dual holding capacity.

These outwardly-extending deformations interrupt the smooth holding surface and provide a mechanical interlock between the lifting apparatus 20 and the load 18, as described above.

As is shown in FIG. 4, the primary vacuum pad 31 provides an initial hold which will pull the load 18 into proximity to the holding face 33. Suction through the channels 34 provide the secondary lifting capacity which supplements the lifting capacity of primary vacuum pad 31.

Figure 5:
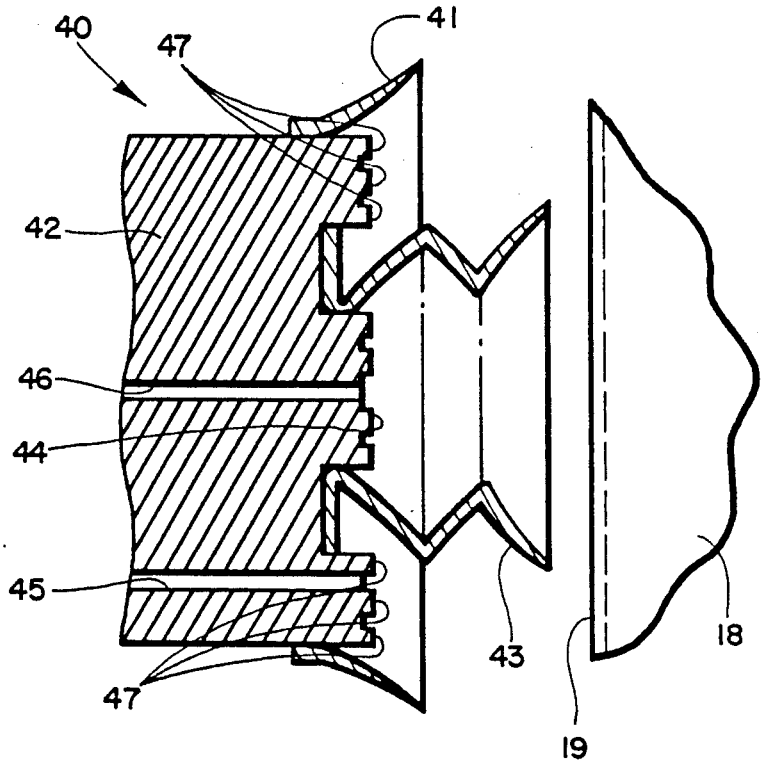
FIG. 5 is a vertical cross-sectional view of a vacuum pad according to another embodiment of the invention.

Referring to FIG. 5, lifting apparatus 40 illustrates the use of a first, annular exterior vacuum pad 41 which is mounted to an annular head 42 and which flares outwardly towards its free end. A second, annular interior vacuum pad 43 is mounted to head 42 concentric with exterior vacuum pad 41. Interior vacuum pad 43 extends outwardly beyond the free end of exterior vacuum pad 41 so that it contacts wall 19 of load 18 first. Interior vacuum pad 43 is pleated in a bellows-like fashion so that it collapses on itself as vacuum is applied. Face 44 of vacuum head 42 is supplied with negative air pressure through vacuum lines 45 and 46, one of which supplies vacuum to the area exterior to interior to the interior vacuum pad 43, and one of which supplies vacuum to the area interior to interior vacuum pad 43. Face 44 also includes a plurality of concentric vacuum channels 47 supplied with vacuum by vacuum line 46 through cross-channels not shown. The vacuum channels 47 act on wall 19 of load 18 in the manner described above, by deforming wall 19 and providing an enhanced grip against shear-induced slippage of load 18.

In addition, interior vacuum pad 43 enhances the ability of the lifting apparatus 40 to adjust to misalignment or incorrect position of the load 18. Pad 43 is smaller and more easily contacts and exerts an initial vacuum force on wall 19. Once a firm contact has been established, the larger pad 41 applies a stronger lifting force. The presence of two vacuum pads also provides an extra opportunity to achieve a proper seal. The longer length of interior vacuum pad 43 renders it more flexible, while the bellows shape permits asymmetrical adjustment to the wall 19 while establishing and maintaining the vacuum. The interior vacuum pad 43 compresses under the influence of vacuum until the outer edge of the exterior vacuum pad 41 contacts wall 19, whereupon a greater vacuum pressure is exerted on wall 19. Finally, engagement of wall 19 with face 44 provides even greater vacuum holding in addition to the mechanical resistance against shear discussed above.

Figure 6:
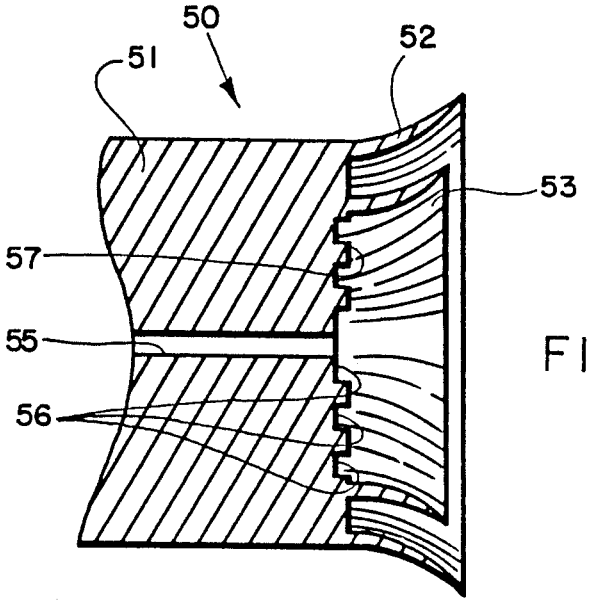
FIG. 6 is a vertical cross-sectional view of a vacuum pad according to a further embodiment of the invention.

A similar construction is shown in FIG. 6 with reference to a lifting apparatus 50. An annular head 51 is provided with an annular integrally-formed exterior vacuum pad 52 for initially engaging the wall of a load. An annular integrally-formed interior vacuum pad 53 subsequently engages the wall of the load, thereby providing enhanced vacuum pressure on the load.

Vacuum is supplied to both the area exterior and interior to interior vacuum pad 53 by a vacuum line 55. Vacuum channels 56 in face 57 subsequently engage the wall as it is drawn inwardly by vacuum pressure providing mechanical resistance against shear as discussed above. Since exterior vacuum pad 52 extends further out from head 51 than the interior vacuum pad 53, the single vacuum line services both.

Figure 7:
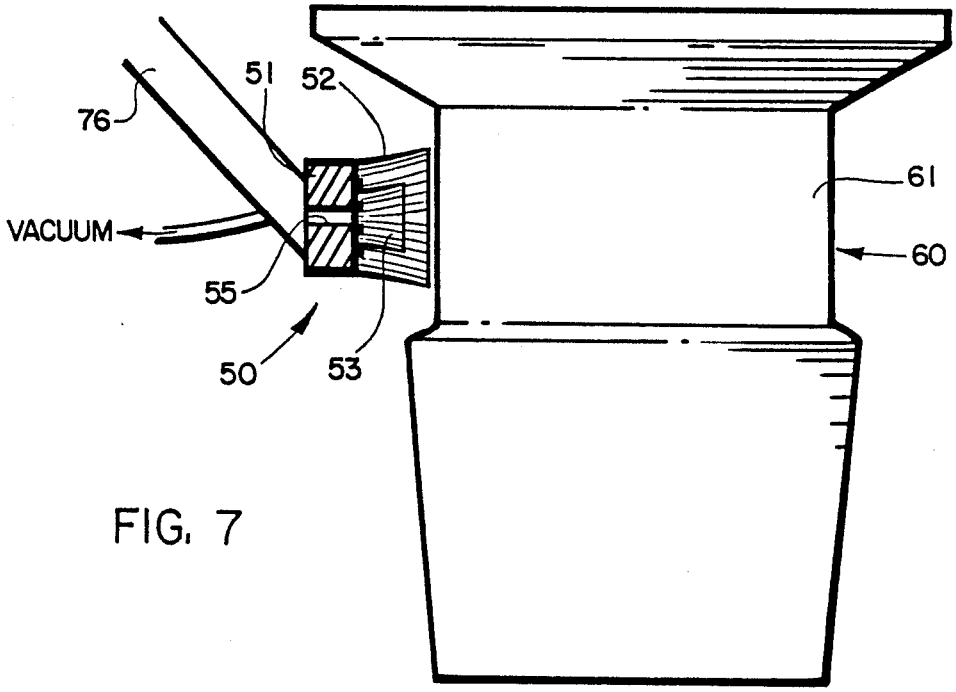
FIG. 7 is a vertical cross-sectional view of a vacuum pad as used to pick up a container having a narrowed waist.

Utility of the various designs disclosed above can be further enhanced depending upon the shape of the load being lifted. As is shown in FIG. 7, a refuse container 60 having a narrowed waist 61 can be lifted using the larger areas of the container adjacent waist 61 as a means of preventing shear-induced slippage. Other designs are possible, such as a cluster of non-concentric interior pads within a larger pad.

Figure 8:
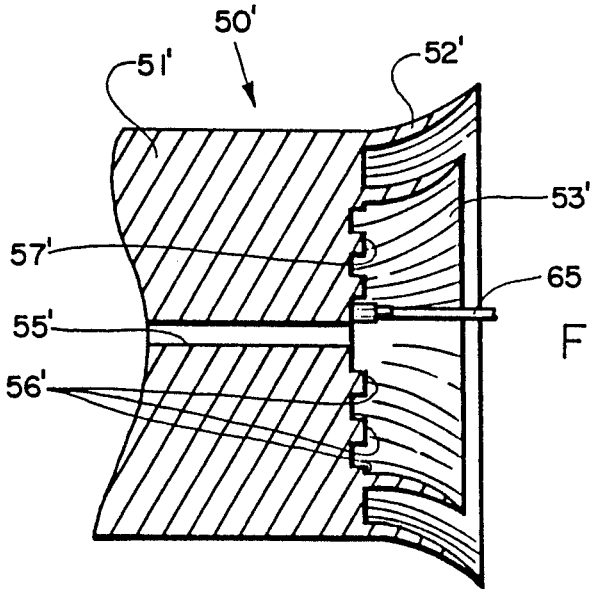
FIG. 8 is a vertical cross-sectional view of a vacuum pad having a sensor probe to determining proximity to the load to be lifted.
Figure 9:
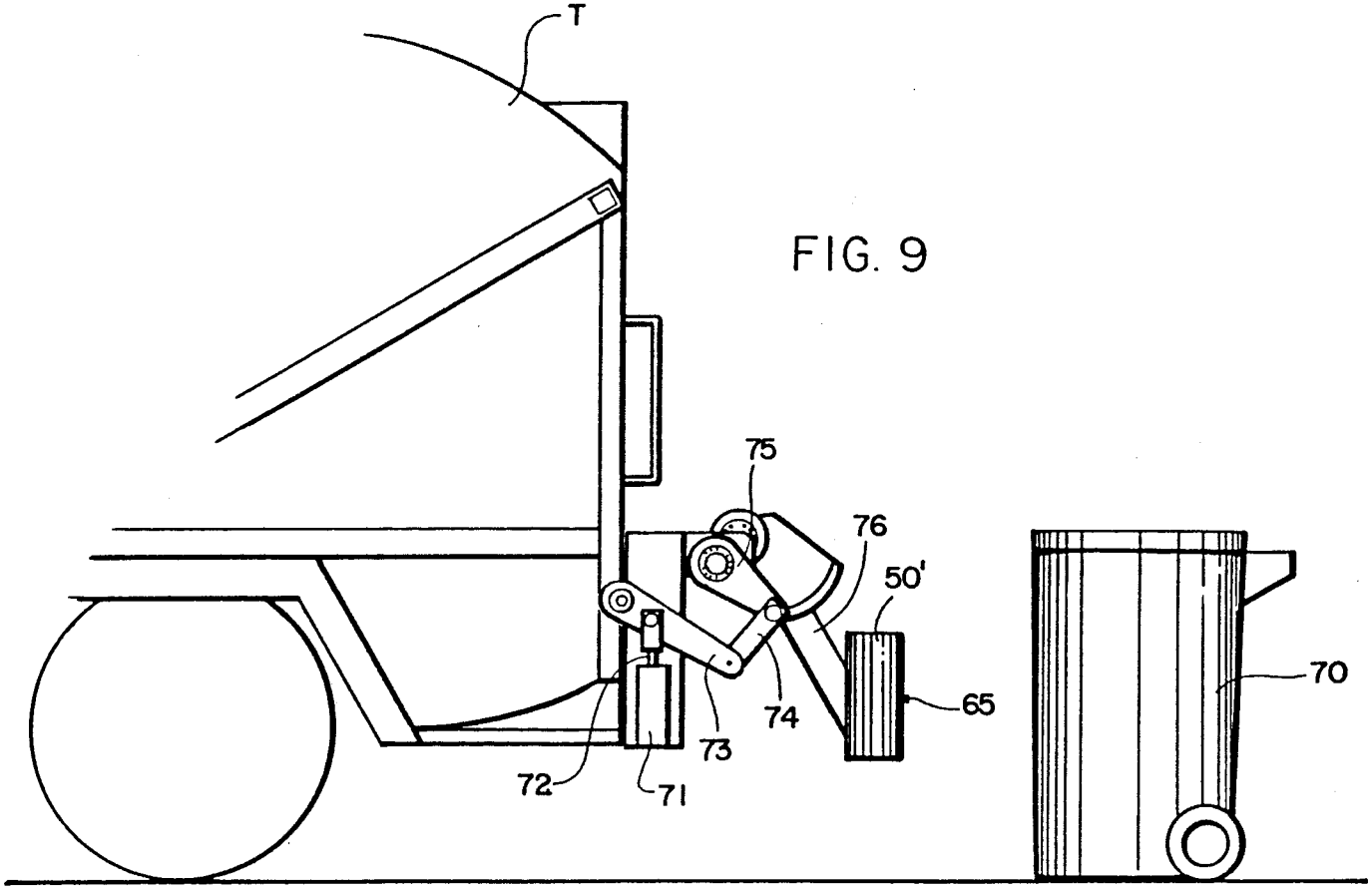
FIGS. 9–12 are sequential views of the vacuum lifting apparatus in operation on the rear of a refuse collection truck.
Figure 10:
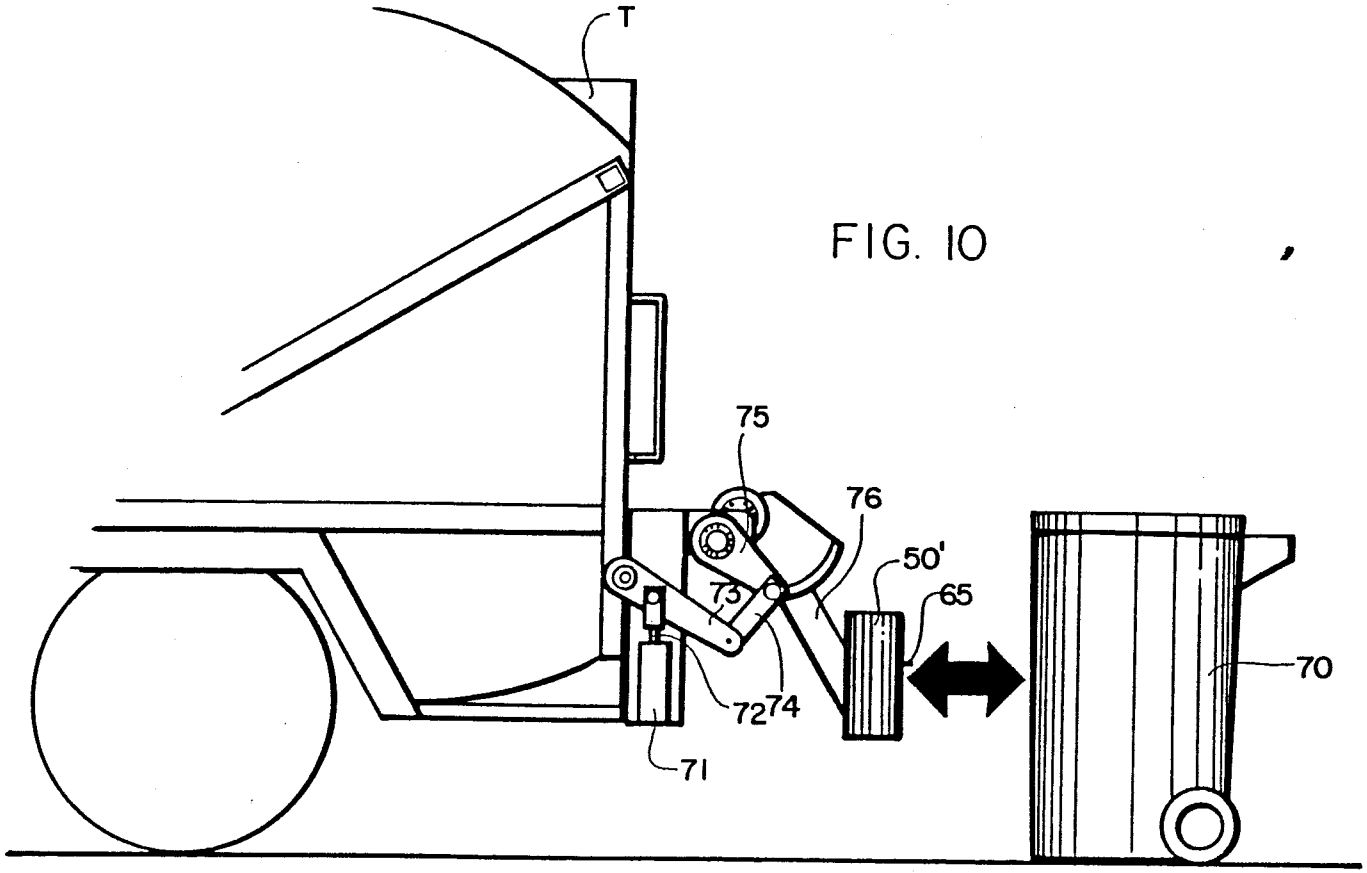

Referring now to FIG. 8, the embodiment shown in FIG. 6 is shown in a variant form lifting apparatus 50' with a sensor probe 65 projecting outwardly towards the free ends of the interior and exterior vacuum pads 53 and 52. Movement of the load into contact with probe 65 switches on the vacuum through a conventional electrical circuit, not shown. This permits vacuum to be automatically switched on when the load is in position for the lifting operation to begin. Vacuum pressure is thereby conserved until needed.

Referring now to FIGS. 9–13, operation of the lifting apparatus according to a preferred embodiment of the invention is illustrated. Of course, the preferred one of the various lifting apparati described above depends on the size and construction of the load to be lifted, the material from which the load is manufactured, weather conditions likely to be encountered and similar conditions. The shape of the lifting apparatus used will depend on the shape of the load to be lifted.

In FIGS. 9–13, a load in the form of a cylindrical "rollout" refuse container 70 is shown. For purposes of illustration lifting apparatus 50' is shown, having a curved face conforming to the curve of container 70. Lifting apparatus 50' is mounted on the rear of a refuse collection truck "T" and includes a hydraulic cylinder 71 having a reciprocating piston arm 72 mounted to a inner pivot arm 73. Inner pivot arm 73 is mounted on an outer pivot arm 74. Outer pivot arm 74 is mounted to the outer free end of a crank arm 75. Rotation of crank arm 75 through the above-described linkage moves a lift arm 76 onto which is mounted vacuum head 51'.

Figure 11:
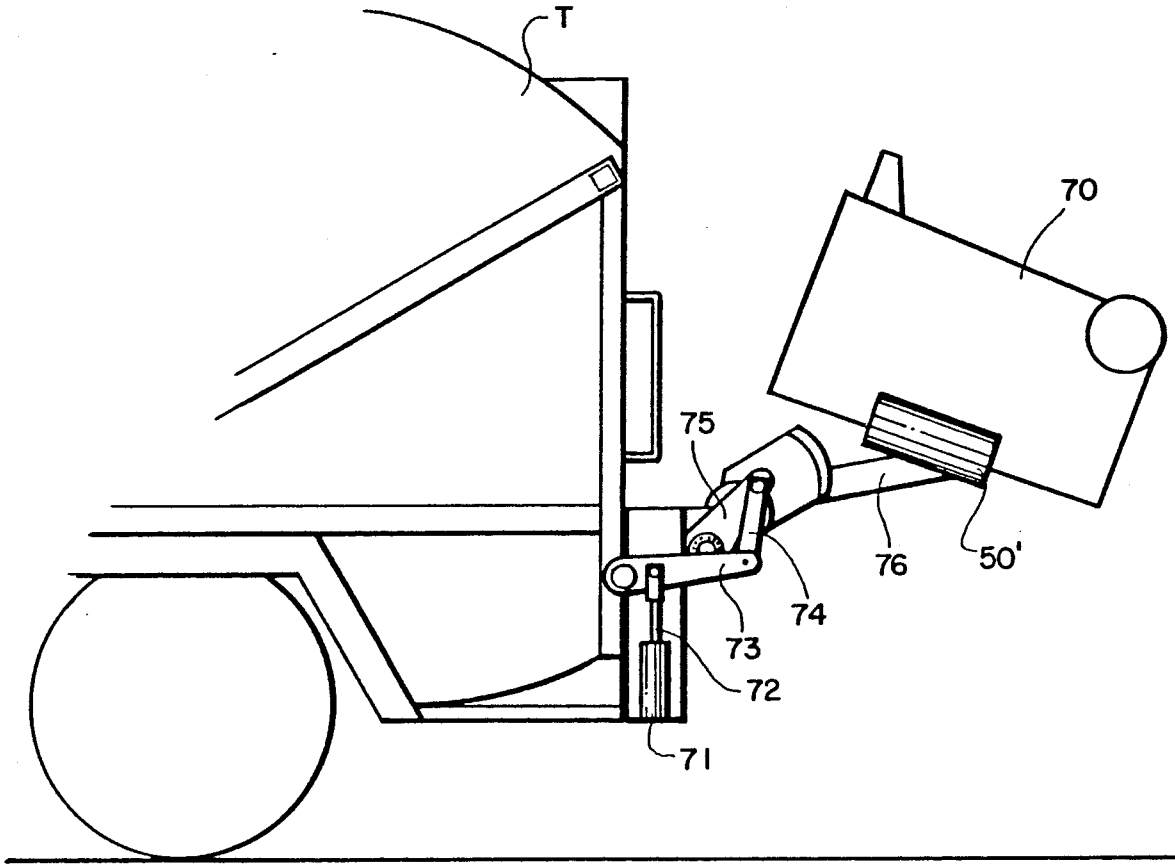
Figure 12:
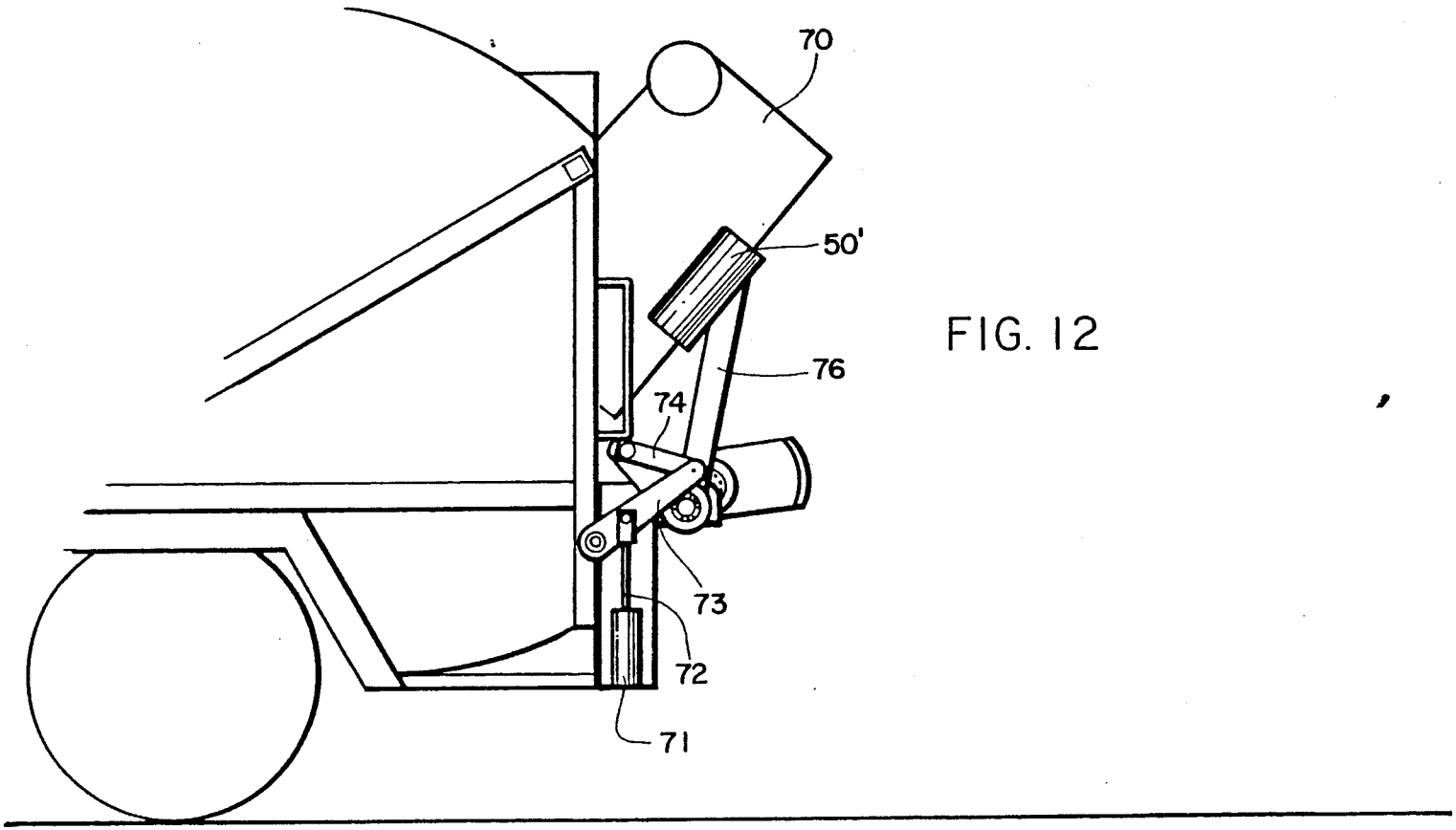

The lifting operation is begun by moving the container 70 towards head 51' until container 70 contacts and depresses probe 65. Vacuum pressure is then exerted on the container 70. When adequate vacuum pressure is exerted on container 70, the lift arm 76 raises the container in the manner described above. A conventional vacuum pressure sensing circuit, not shown, detects when vacuum head 51' is fully seated on the container 70. As is shown in FIGS. 11 and 12, the container is substantially inverted into the truck "T". A switch, such as a conventional limit switch, stops upward movement of the lifting apparatus 50' and reverses the process, lowering the lift arm 76 and the container 70 to the road surface where the vacuum is released. This may be done manually be an operator or automatically by a limit switch. Preferably, the stopping motion at the top of the dumping cycle is somewhat abrupt, so that the container stops suddenly, while the refuse in the container is propelled forward by inertia out of container 70 and into the truck.

Figure 13:
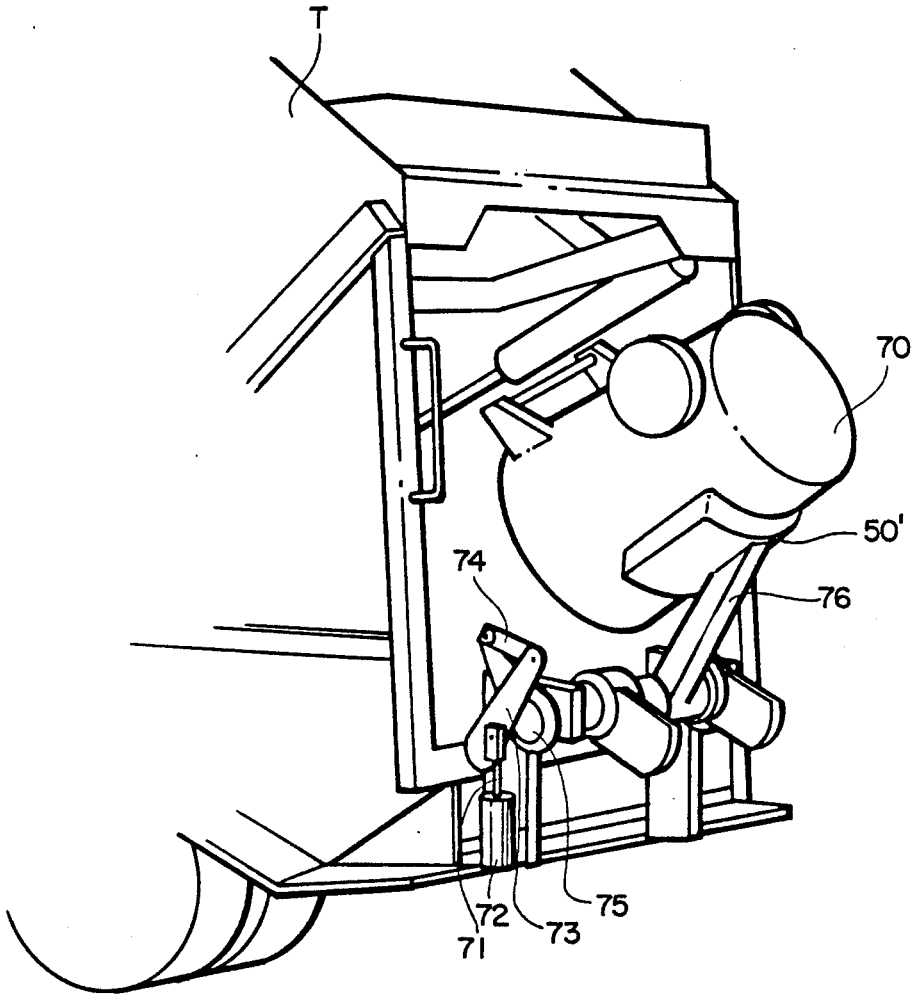
FIG. 13 is a perspective view of the vacuum lifting apparatus in its raised position illustrating that orientation of the container is unnecessary.

A perspective view of the container 70 at its uppermost dumping position is shown in FIG. 13. Aside from a view of several elements of the lifting apparatus 51' different from the side elevations of FIGS. 9–12, the position of container 70 illustrates that a cylindrical container offers the advantage that the container need not be rotationally oriented in relation to vacuum head 51'—it need only be brought into contact with head 51' while in correct parallel and axial orientation.

The various vacuum heads disclosed above may be of any suitable peripheral shape. For the heads having pleated, bellows-like pads, such as in FIGS. 3–6, an annular shape is most suitable. A square or rectangular shape is also possible, as is shown in FIGS. 9–13. The heads are preferably fabricated of a flexible rubber-like material, such as neoprene. In environments where significant temperature ranges can be expected, the material should be of a type resistant to hardening or cracking at low temperature, such as silicone rubber. Selection of suitable materials given particular environmental and operating conditions is within the capacity of one of ordinary skill in the art. Calculation of vacuum pressures and head capacities for a given embodiment are conventional engineering problems, the solutions to which may be determined by those of ordinary skill in the art based on the teachings and in light of the considerations outlined above. The deformation of the side walls of the load in the manner described above will require consideration of the wall thickness of the load and the behavior of the material from which the load is constructed at various temperatures and under various weather conditions, the size and spacing of the vacuum channels and the overall surface area of vacuum pressure applied to the load.

A lifting apparatus is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A vacuum-controlled vertical lifting apparatus for lifting a load, and comprising:

(a) primary vacuum means for initially engaging said load, said primary vacuum means comprising a vacuum head for exerting a vacuum-induced suction grip on the load, said vacuum head including a first resilient vacuum pad defining a first load-contacting surface, the load-contacting surface of said first resilient vacuum pad having a first outwardly-extending load-engaging flange for first engaging the load as the lifting apparatus and load are moved together;

(b) secondary vacuum means carried by said vacuum head for secondarily engaging said load and supplementing the vacuum-induced grip on the load, said secondary vacuum means comprising a second resilient vacuum pad positioned within the periphery of said first resilient vacuum pad and defining a second load-contacting surface, the load-contacting surface of said secondary vacuum means including a second outwardly-extending load-engaging flange of a length for engaging the load before engagement between the load and said first vacuum pad, said first and second flanges having walls of decreasing thickness towards said free end; and (c) lifting means for effecting vertical movement of said load.

2. A vacuum-controlled vertical lifting apparatus for lifting a load, and comprising:

(a) primary vacuum means for initially engaging said load, said primary vacuum means comprising a vacuum head for exerting a vacuum-induced suction grip on the load, said vacuum head comprising a first resilient vacuum pad defining a first load-contacting surface;

(b) secondary vacuum means carried by said vacuum head for secondarily engaging said load and supplementing the vacuum-induced grip on the load, said secondary vacuum means comprising a second resilient vacuum pad positioned within the periphery of said first resilient vacuum pad and defining a second load-contacting surface;

(c) said first load-contacting surface comprising a load-engaging flange, and said second load-contacting surface comprising spaced-apart mechanical engagement means for bearing against and deforming the load into spaces therebetween to provide a mechanical lifting assist against vertical shearing movement of the load against said first load-contacting surface, said mechanical engagement means comprising laterally and outwardly extending lugs; and (d) lifting means for effecting vertical movement of said load.

3. A vacuum-controlled vertical lifting apparatus for lifting a load, and comprising:

(a) primary vacuum means for initially engaging said load, said primary vacuum means comprising a vacuum head for exerting a vacuum-induced suction grip on the load, said vacuum head comprising a first resilient vacuum pad defining a first load-contacting surface;

(b) secondary vacuum means carried by said vacuum head for secondarily engaging said load and supplementing the vacuum-induced grip on the load, said secondary vacuum means comprising a second resilient vacuum pad positioned within the periphery of said first resilient vacuum pad and defining a second load-contacting surface;

(c) said first load-contacting surface comprising a first load-engaging flange, and said second load-contacting surface comprising spaced-apart mechanical engagement means for bearing against and deforming the load into spaces therebetween to provide a mechanical lifting assist against vertical shearing movement of the load against said first load-contacting surface, said mechanical engagement means comprising laterally and outwardly extending lugs;

(d) the load-contacting surface of said first resilient vacuum pad comprising a first outwardly-extending load-engaging flange for first engaging the load as the lifting apparatus and load are moved together, and the load-contacting surface of said secondary vacuum means including a second outwardly-extending load-engaging flange of a length for engaging the load after engagement between the load and said first vacuum pad; and (e) lifting means for effecting vertical movement of said load.

4. A vacuum controlled gripping apparatus for gripping a load, and comprising:

(a) primary vacuum means for initially engaging said load, said primary vacuum means comprising a vacuum head for exerting a vacuum-induced suction grip on the load, said vacuum head comprising a first resilient vacuum pad defining a first load-contacting surface;

(b) secondary vacuum means carried by said vacuum head for secondarily engaging said load and supplementing the vacuum-induced grip on the load, said secondary vacuum means comprising a second resilient vacuum pad positioned within the periphery of said first resilient vacuum pad and defining a second load-contacting surface; and (c) the load-contacting surface of said first resilient vacuum pad comprising a first outwardly-extending load-engaging flange for first engaging the load as the gripping apparatus and load are moved together, and the load-contacting surface of said secondary vacuum means including a second outwardly-extending load-engaging flange of a length for engaging the load before engagement between the load and said first vacuum pad, said first and second load-engaging flanges being both circular and each defining a circle of increasing diameter towards a free end thereof.

5. A vacuum-controlled gripping apparatus for gripping a load, and comprising:

(a) primary vacuum means for initially engaging said load, said primary vacuum means comprising a vacuum head for exerting a vacuum-induced suction grip on the load, said vacuum head comprising a first resilient vacuum pad defining a first load-contacting surface;

(b) secondary vacuum means carried by said vacuum head for secondarily engaging said load and supplementing the vacuum-induced grip on the load, said secondary vacuum means comprising a second resilient vacuum pad positioned within the periphery of said first resilient vacuum pad and defining a second load-contacting surface; and (c) the load-contacting surface of said first resilient vacuum pad comprises a first outwardly-extending load-engaging flange for first engaging the load as the gripping apparatus and load are moved together, and the load-contacting surface of said secondary vacuum means including a second outwardly-extending load-engaging flange of a length for engaging the load before engagement between the load and said first vacuum pad, said first and second load-engaging flanges being both circular and each defining a circle of increasing diameter towards a free end thereof and wherein said first and second load-engaging flanges have wall of decreasing thickness towards said free end.

6. A vacuum-controlled gripping apparatus for gripping a load, and comprising:

(a) primary vacuum means for initially engaging said load, said primary vacuum means comprising a vacuum head for exerting a vacuum-induced suction grip on the load;

(b) secondary vacuum means carried by said vacuum head for secondarily engaging said load and supplementing the vacuum-induced grip on the load;

(c) said vacuum head comprising a first resilient vacuum pad defining a first load-contacting surface, and wherein said secondary vacuum means comprises a second resilient vacuum pad positioned within the periphery of said first resilient vacuum pad and defining a second load-contacting surface; and (d) said first load-contacting surface comprising a load-engaging flange, and said second load-contacting surface comprising a spaced-apart mechanical engagement means for bearing against and deforming the load into spaces therebetween to provide a mechanical lifting assist against vertical shearing movement of the load against said first load-contacting surface, said mechanical engagement means comprising laterally and outwardly extending lugs.

7. A vacuum-controlled gripping apparatus for gripping a load, and comprising:

(a) primary vacuum means for initially engaging said load, said primary vacuum means comprising a vacuum head for exerting a vacuum-induced suction grip on the load;

(b) secondary vacuum means carried by said vacuum head for secondarily engaging said load and supplementing the vacuum-induced grip on the load;

(c) said vacuum head comprising a first resilient vacuum pad defining a first load-contacting surface, and said secondary vacuum means comprising a second resilient vacuum pad positioned within the periphery of said first resilient vacuum pad and defining a second load-contacting surface; and (d) said first load-contacting surface comprising a load-engaging flange and said second load-contacting surface comprising spaced-apart mechanical engagement means for bearing against and deforming the load into spaces therebetween to provide a mechanical lifting assist against vertical shearing movement of the load against said first load-contacting surface, said mechanical engagement means comprises laterally and outwardly extending lugs.

8. A vacuum-controlled vertical lifting apparatus according to claim 3, wherein said first and second load-engaging flanges are both circular and each define a circle of increasing diameter towards a free end thereof.

9. A vacuum-controlled vertical lifting apparatus according to claim 1 or 3, wherein said first and second load-engaging flanges have walls of decreasing thickness towards said free end.

10. A vacuum-controlled vertical lifting apparatus according to claim 1, 2, 3, 4, 5, 6, or 7, wherein said first load-engaging flange includes bellows-like pleats to permit the flange collapse on itself as vacuum is exerted on the load.

11. A vacuum-controlled vertical lifting apparatus according to claim 1, 4, or 5, wherein said mechanical engagement means comprises laterally and outwardly extending lugs.

12. A vacuum-controlled vertical lifting apparatus according to claim 1, 2, 3, 4, 5, 6 or 7, and including sensor means for sensing a predetermined location of the load relative to said vacuum head and activating the vacuum upon the occurrence of said predetermined location.

13. A vacuum-controlled vertical lifting apparatus according to claim 1, 2, 3, 4, 5, 6 or 7, wherein said load comprises a refuse container.

14. A vacuum-controlled vertical lifting apparatus according to claim 1, 2, 3, 4, 5, 6, or 7, wherein said load comprises a plastic refuse container.

15. A vacuum-controlled vertical lifting apparatus according to claim 1, 2, 3, 4, 5, 6, or 7, and including means for attaching to and carrying said apparatus on a refuse collection vehicle.

* * * * *